United States Patent [19]

Menke

[11] Patent Number: 5,004,247

[45] Date of Patent: Apr. 2, 1991

[54] ELECTRONIC DART BOARD

[75] Inventor: Wilhelm Menke, Wiesbaden, Fed. Rep. of Germany

[73] Assignee: NSM Apparatebau GmbH & Co. KG, Bingen, Fed. Rep. of Germany

[21] Appl. No.: 392,925

[22] PCT Filed: Dec. 24, 1987

[86] PCT No.: PCT/DE87/00608

§ 371 Date: Jul. 19, 1989

§ 102(e) Date: Jul. 19, 1989

[87] PCT Pub. No.: WO88/05521

PCT Pub. Date: Jul. 28, 1988

[30] Foreign Application Priority Data

Jan. 24, 1987 [DE] Fed. Rep. of Germany ..... 3702135
Jul. 15, 1987 [DE] Fed. Rep. of Germany ..... 3723298

[51] Int. Cl.[5] ..... F41J 5/04; A47B 88/00
[52] U.S. Cl. ..... 273/376; 312/328
[58] Field of Search ..... 273/376, 374; 312/328

[56] References Cited

U.S. PATENT DOCUMENTS 3,454,276 7/1969 Brehkert ..... 273/376
4,881,744 11/1989 Hansen ..... 273/376

FOREIGN PATENT DOCUMENTS 3038829 4/1982 Fed. Rep. of Germany ..... 273/376
587980 5/1947 United Kingdom ..... 273/376
2130107 5/1984 United Kingdom ..... 273/376

*Primary Examiner*—Benjamin Layno
*Attorney, Agent, or Firm*—Spencer & Frank

[57] ABSTRACT

An amusement machine with darts has a target disk arranged in an opening of the front wall of a housing, with moving segments worth different numbers of points and provided with dart receiving holes. When a dart hits a segment, it activates by means of an elastic backing a switching group arranged between the backing and a base plate, thus enabling the automatic recording, counting and display of the points achieved by electric and/or electronic components. The elastic backing (17), the switching group (16) and the base plate (18) are transparent to light and can be folded back together as a unit (31) with the target disk (4), starting from the front wall (25) and then the target disk (4). At least one light source (22) is provided inside the housing (1) behind the base plate (18).

14 Claims, 6 Drawing Sheets

ELECTRONIC DART BOARD

BACKGROUND OF THE INVENTION

The invention relates to a dart game including a dart target disk attached in an opening in the front wall of a housing. The movable segments of the dart target disk are assigned different numbers of points and are provided with holes to accept the thrown darts. When a dart strikes a segment, a group of switches disposed between an elastic support and a carrier plate are actuated through this support so as to permit, via electrical and/or electronic components, automatic recording, counting and display of the points earned.

Such dart games are known in the most varied embodiments. For example, DE-OS 3,341,303 discloses a dart game which includes a dart target disk fastened above a group of switches arranged in the form of a switch matrix, with the segments of the target disk actuating the switch matrix if it is struck by a dart thrown by a player. The dart game includes a first microcomputer for scanning the switch matrix in order to determine where the dart has struck the target disk and a second microcomputer which performs a plurality of tasks, such as calculation of the number of points for each player and actuation of the display units to inform the players about game conditions and the number of points won per game for each player. The dart target disk of this device is fastened to an opening in the front wall of the housing by means of screws and a holding ring. The switch matrix disposed in the interior of the housing behind the dart target disk is embedded between a rubber support and a carrier plate. Along its periphery, it is held at the front plate by means of threaded screws with associated nuts and by spacers surrounding the threaded screws. To remove broken dart tips stuck in the dart target disk, it is necessary to initially move the device away from the wall against which it usually stands to gain access to the rear of the device for opening the rear wall. After opening the rear wall of the device, all components lying in front of the switch matrix—seen from the rear of the device—must be removed from the interior of the housing. Then all nuts must be removed from the screws supporting the switch matrix and only then can the unit composed of rubber support, switch matrix and carrier plate be pulled away from the holding screws to provide free access to the rear of the individual segments of the dart target disk, thus making it possible to push the broken dart tips out of the dart target disk. After removal of the broken dart tips from the dart target disk, the game device must be re-assembled in the reverse sequence. Such a procedure for removing broken dart tips is thus inevitably extremely complicated and time consuming which consequently lead to disproportionately long interruptions of play.

Additionally, it is customary in prior art dart games to illuminate the dart target disk by providing a lamp fastened to a projecting holding arm or the like at the front wall of the device. However, this type of illumination of the dart target disk is disadvantageous insofar as a beam of light impinging obliquely on the dart target disk will throw a heavy shadow within the dart target disk and thus will not illuminate the dart target disk uniformly. On the other hand, there exists the danger of damage to the holding arm and the lamp during work on the device, particularly during the removal of broken dart tips from the dart target disk.

Additionally, DE A-3,038,029 discloses a target disk holder for firing ranges in which the target disk holder is disposed on a movable carriage that can be pulled toward the marksman by means of a cable pulley. The target disk holder is composed of a spring-tensioned double frame which can be folded open and into which the target disk can be clamped.

Moreover, GB-A-587,980 discloses a dart game whose dart target disk is accommodated in a curved frame. The frame is composed of a rear wall, a conical side wall and a cylindrical wall into which is inserted a light transmitting component to accommodate the darts. A light source is disposed in the area between the rear wall of the frame and the light transmitting component.

SUMMARY OF THE INVENTION

It is the object of the invention to provide a dart game of the above-mentioned type in which the easy and quick removal of broken dart tips stuck in the dart target disk and the exchange of damaged segments of the dart target disk is ensured, and at the same time optimum illumination of the dart target disk is guaranteed.

This is accomplished according to the invention in that the elastic support, the group of switches and the carrier plate are made transparent and can be folded away from the front wall as a unit together with the dart target disk and subsequently from the dart target disk, with at least one light source being provided within the housing behind the carrier plate.

The transparency of the components disposed behind the dart target disk permits uniform illumination of the entire dart target disk, thus making details of the dart target disk, particularly any broken dart tips possibly stuck in it, clearly visible from even a greater distance. Moreover, the solution according to the invention makes it possible to obtain free access to the rear of the segments of the dart target disk by only two folding steps so as to remove the broken dart tips or exchange defective segments, if necessary. Thereafter it then again requires only two folding steps, of course in the reverse sequence, to make the dart game ready for playing. Such manipulation can be performed very quickly and thus causes only a short interruption of play.

In order to be able to adapt the illumination of the dart target disk to light conditions surrounding the dart game, one feature of the invention provides that the intensity of the light source can be regulated by way of an associated dimmer. Advisably, a reflector which covers the entire carrier plate is then associated with the light source which is disposed centrally relative to the carrier plate.

According to an advantageous modification of the subject matter of the invention, the carrier plate is provided with a plurality of receiving pins which are arranged behind the ribs of the dart target disk and project in the direction of the dart target disk. The group of switches as well as the elastic support are fastened to the carrier plate by way of bores which mate with the receiving pins. Thus, after the carrier plate has been folded away from the folded-away dart target disk, it is thus ensured that the elastic support as well as the group of switches can be exchanged quickly.

In order to prevent damage to the region of the front wall surrounding the dart target disk from darts missing their target as well as such darts dropping to the ground, a further feature of the invention provides that the dart target disk is surrounded by segments which are fixed on its periphery and are not occupied by a point number. These segments can be folded away from the front wall of the housing together with the dart target disk. Thus, broken dart tips can also be easily removed from these non-counting segments.

The dart target disk is preferably held in the front wall of the housing by way of a hinge and a locking device disposed opposite the hinge. Moreover, preferably the carrier plate is connected with the dart target disk by way of a hinge and, in its folded-in state in the front wall, lies against a corresponding stop in the front wall on the side of the housing. The hinges may of course be disposed in any desired position between the mentioned components.

Another advantageous embodiment of the solution according to the invention is distinguished in that the hinge between the dart target disk and the front wall is disposed in the lower region of the opening in the front wall; the hinge between the carrier plate and the dart target disk lies in the same plane as the above-mentioned hinge and the carrier plate together with the group of switches and the elastic support can be fixed by means of a holding device when the dart target disk is folded away into its folded-up position. This ensures particularly easy access to the components that can be folded away.

It is also possible to subdivide the dart target disk into a plurality of segment-shaped sections which can each be separately folded away from the front wall.

In order to prevent the throwing of darts onto the dart target disk after coin-operated games are completed, a further advantageous feature of the invention provides that a removable cover plate is provided in front of the dart target disk. This cover plate is preferably composed of glass or some other transparent material to always permit a view onto the dart target disk. Advisably, the cover plate is arranged so as to be retractable into the interior of the housing and is spaced at a distance from the dart target disk which is greater than the distance of the free ends of darts stuck in the dart target disk from the dart target disk.

A further advantageous feature of the invention provides that the cover plate can be moved automatically into the open and closed position by way of an actuation device coupled to it. In the open position, the cover plate is retracted into the lower portion of the housing and in the closed position it is disposed in front of the dart target disk. The actuation device is switched in such a way that, at the onset of a coin-operated game, the cover plate automatically moves into the open position and thus makes the dart target disk available while, at the end of the coin-operated game, the cover plate automatically moves into its closed position. Preferably, the actuation device includes a holder which supports the cover plate at its lower edge, a cable guided over a reversing roller and equipped with a compensating spring whose end is fastened to a counterweight and a drive motor coupled with the reversing roller by way of gears. In order to fix the cover plate in its closed position, the cover plate is advisably held in its closed position by a locking device which is charged by a spring and is actuatable by means of an electromagnet. At the start of a game, the electromagnet releases the locking device so that the cover plate is able to move into its retracted open position.

BRIEF DESCRIPTION OF THE DRAWINGS

The idea on which the invention is based will now be described in greater detail by way of a description of an embodiment that is illustrated in the drawing figures, wherein.

DESCRIPTION OF THE PREFERRED EMBODIMENTS

Figure 1:
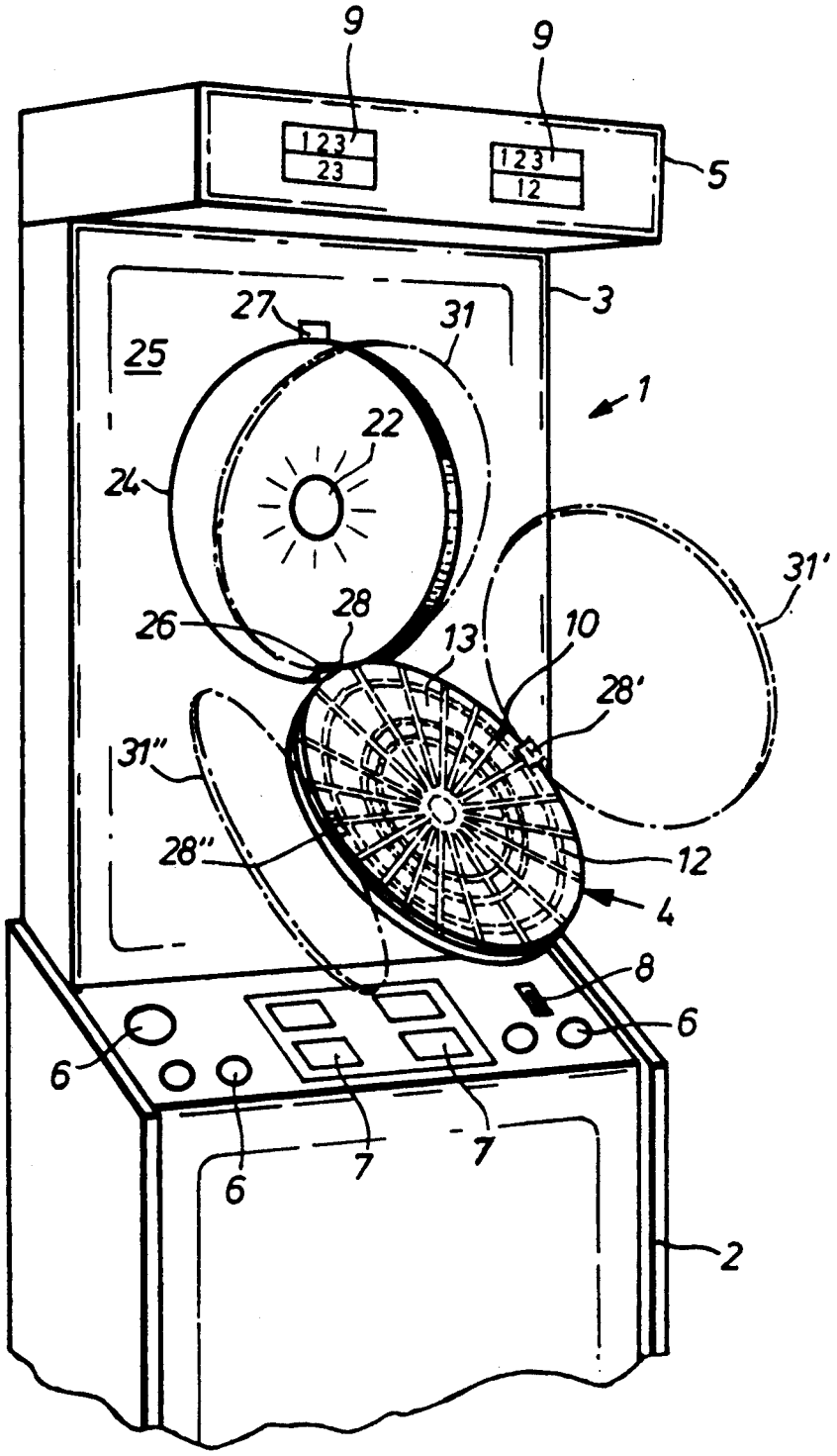
FIG. 1 is a perspective view of the dart game according to the invention, with the dart target disk folded away and with three possibilities, shown in dash-dot lines, for folding away a unit composed of a carrier plate, a group of switches and an elastic support from the dart target disk.
Figure 2:
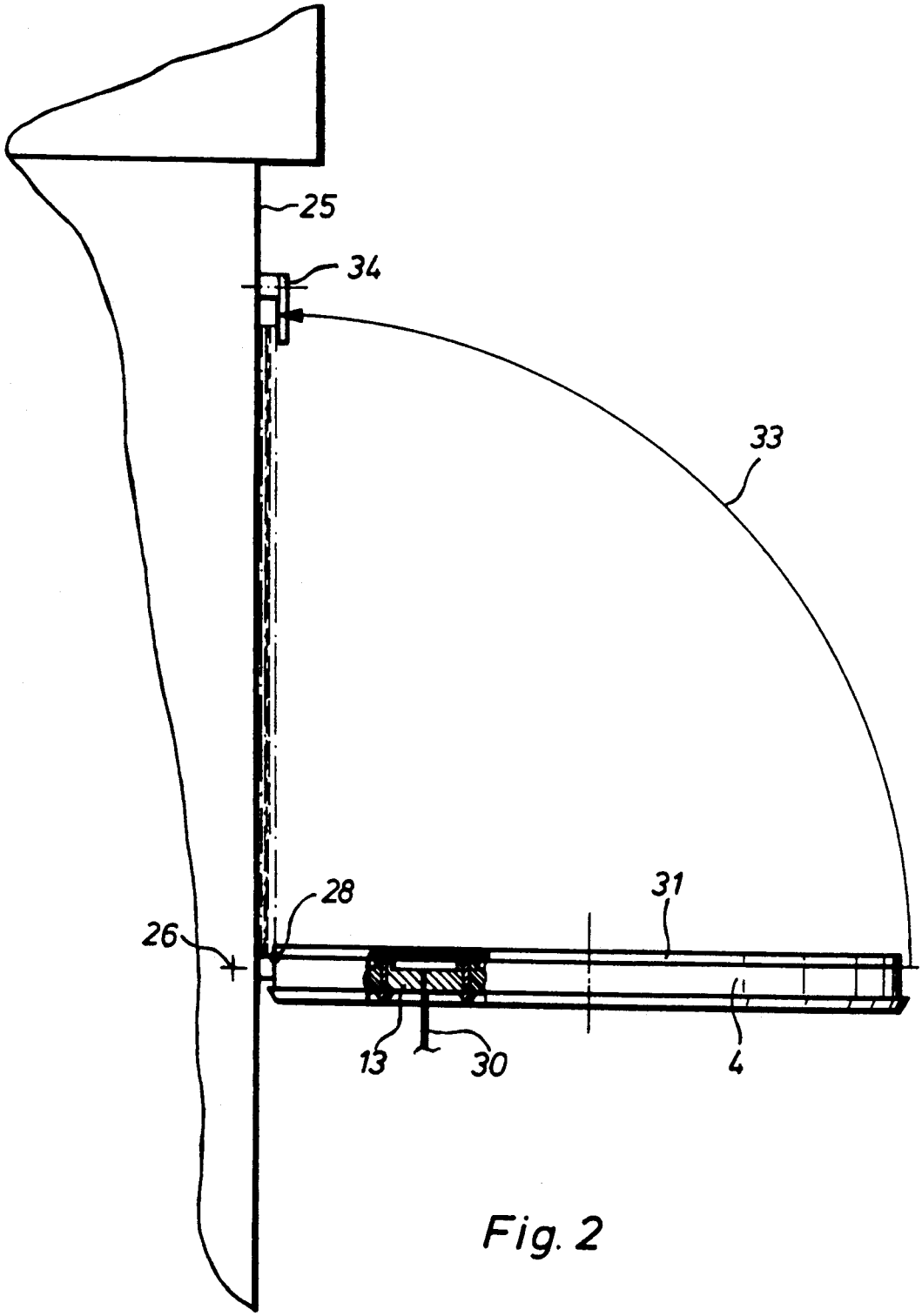
FIG. 2 is a side view of the dart target disk and associated unit folded away from the front wall of the dart game housing, and includes a partial sectional view illustrating components to an enlarged scale.
Figure 3:
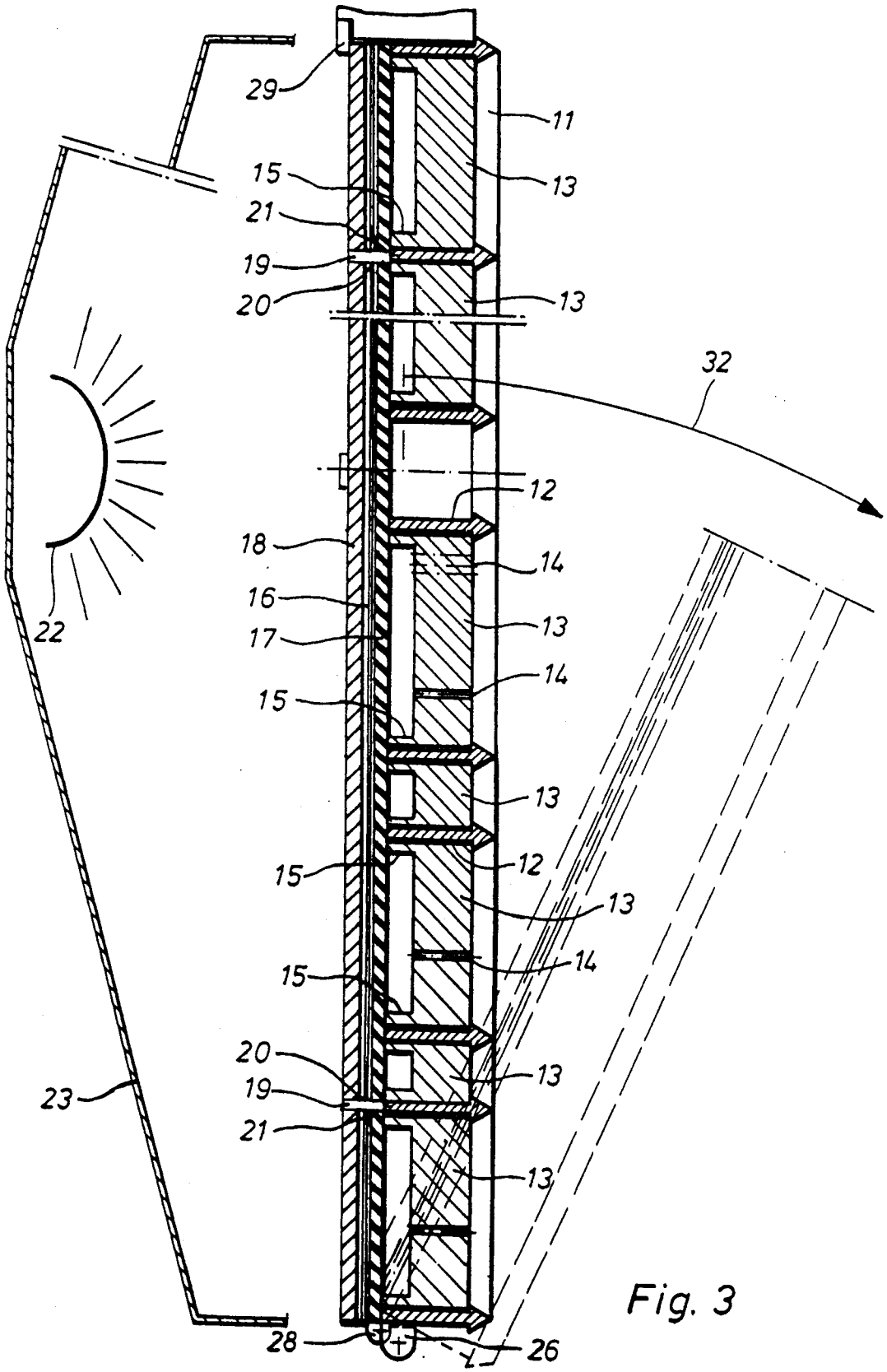
FIG. 3 is an enlarged longitudinal sectional view of the dart target disk, the elastic support, the group of switches and the carrier plate with associated light source and reflector.

As is shown in FIGS. 1–3, the housing 1 of an embodiment of the dart game includes a base 2, an attachment 3 supporting the dart target disk 4 and a hood 5. The various operating elements 6, such as game selection keys, displays 7 for the selected type of game and a coin insertion slot 8, are disposed in the free upper side of base 2. The frontal face of hood 5 is provided with displays 9 for indicating the points earned.

Dart target disk 4 is provided with a plurality of radial ribs 10 which are arranged at a uniform angular spacing from one another and are connected together at their outer ends by a circular rib 11. Dart target disk 4 further comprises a plurality of concentric ribs 12 which are spaced at different distances from one another. The outer sides of all ribs 10, 11, and 12 have the shape of an arrowhead so as to deflect darts thrown into dart target disk 4. Segments 13 are arranged so as to be slidably movable in the spaces between ribs 10, 11 and 12 and are provided with a plurality of openings 14 into which the tip of a dart is able to penetrate. Each segment 13 has feet 15 which cooperate with associated pressure switches of a group of switches 16. Switch group 16 is embedded between an elastic support 17 facing segments 13 and a carrier plate 18. Carrier plate 18 is provided with receiving pins 19 which project in the direction of segments 13 and onto which the group of switches 16 and elastic support 17 are pushed by way of corresponding bores 20, 21 in these components. If a segment 13 is struck by a dart, this segment moves in the direction of carrier plate 18, thus pressing down at least one foot 15 of segment 13 into elastic support 17 to the extent that it closes an associated pressure switch of switch group 16. The thus generated hit pulse is forwarded to a central microprocessor which controls all functions of the game.

Carrier plate 18, switch group 16 and elastic support 17 are composed of light transmitting material. At a certain distance from the center of carrier plate 18, behind this plate, a light source 22 is disposed within housing 1 and has an associated reflector 23 which covers the entire carrier plate 18. Light beams emanating from light source 22 are distributed over the entire carrier plate 18, penetrate it, as well as switch group 16 and elastic support 17 due to the transparency of these components and exit through openings 14 in segments 13 of dart target disk 4, thus producing an illumination free of heavy shadows and thus providing for good visibility of dart target disk 4.

Dart target disk 4 is inserted into a corresponding opening 24 in front wall 25 of attachment 3 of housing 1 and is held in its position by a hinge 26 attached in the lower region of opening 24 between dart target disk and front wall 25 and by a locking device 27 disposed opposite hinge 26. Another hinge 28 disposed in the plane of hinge 26 connects carrier plate 18 with dart target disk 4. Due to a corresponding stop 29 on the side of the housing in the region of opening 24, carrier plate 18 together with switch group 16 and elastic support 17 lie firmly against dart target disk 4.

If a broken dart tip 30 must be removed from a segment 13 of dart target disk 4, release of locking device 27 permits dart target disk 4 together with the unit 31 composed of carrier plate 18, switch group 16 and elastic support 17 to be folded outwardly in the direction of arrow 32 of FIG. 3 away from the front wall 25 of attachment 3. Thereafter, unit 31 must be folded upwardly in the direction of arrow 33 from dart target disk 4 into the position shown in dashed lines in FIG. 2, and in this position it can be fixed by a holding device 34. Thus, the segment 13 of dart target disk 4 holding the broken dart tip 30 is freely accessible from the rear so that the broken dart tip can easily be pressed out of segment 13. At the same time, switch group 16 and/or elastic support 17 can be quickly exchanged, if necessary. At the end of the above-mentioned work, it is merely necessary to fold dart target disk 4 back into its initial position and fix it in that position by means of locking device 27, thus making the device ready for playing again.

The two further units 31' and 31'' shown in FIG. 1 merely constitute two further variations for attachment to dart target disk 4, with these units 31' and 31'' being fastened to dart target disk 4 by way of appropriately placed hinges 28' and 28''. Of course, other variations of fastening unit 31 to dart target disk 4 and of fastening dart target disk 4 to front wall 25 are possible. The decisive factor for the invention is that dart target disk 4 can be folded away from front wall 25 together with unit 31 and unit 31, in turn, can be folded away from dart target disk 4.

Figure 4:
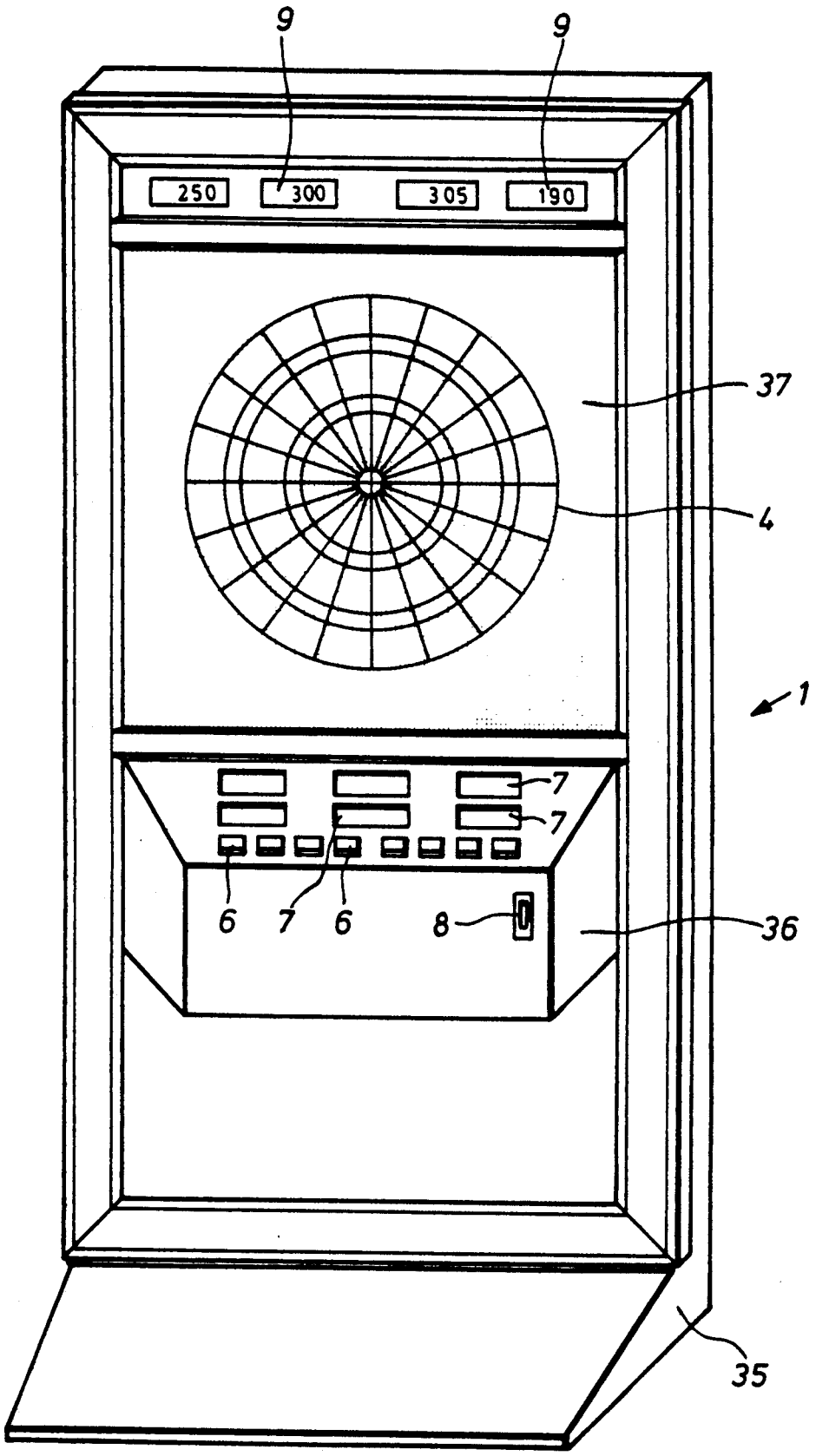
FIG. 4 is a perspective view of an alternative embodiment of the dart game according to FIG. 1 with a retractable glass cover plate attached in front of the dart target disk.
Figure 5:
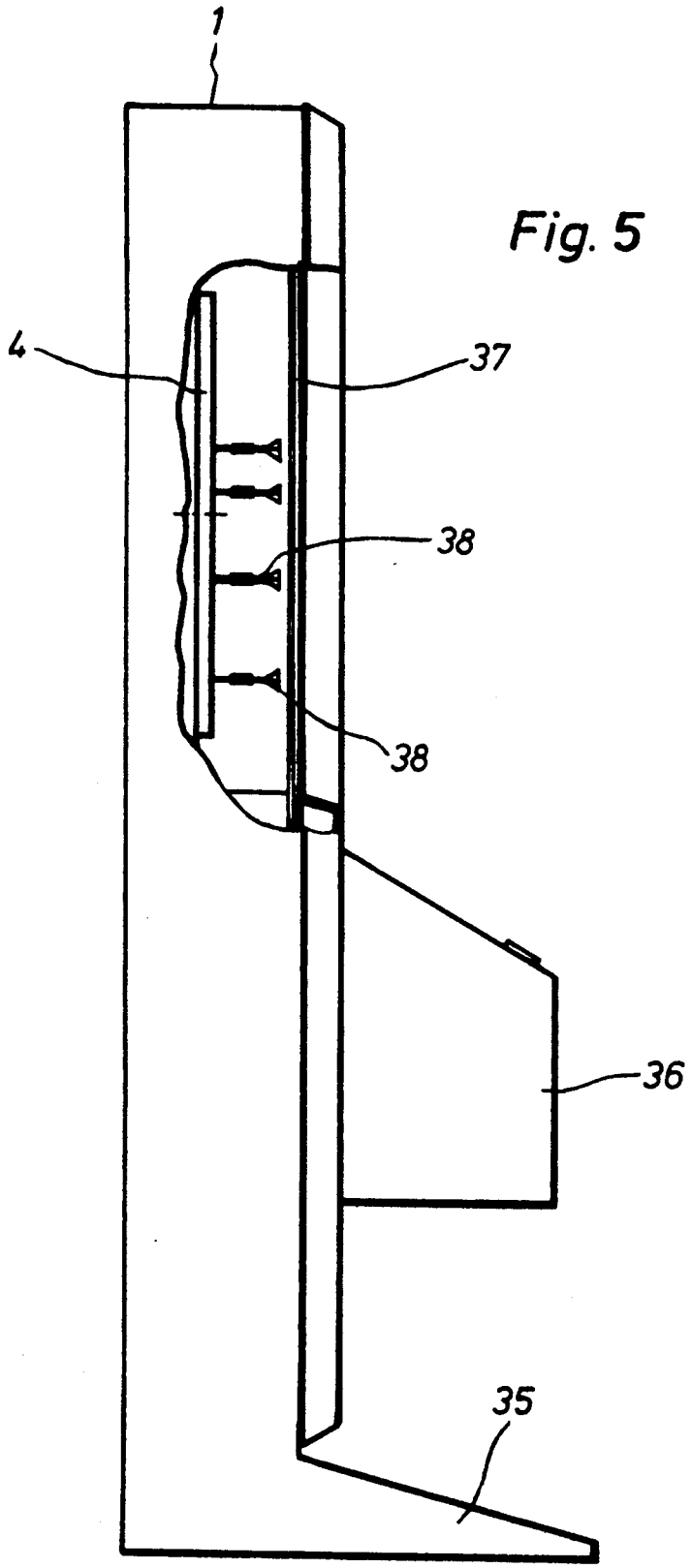
FIG. 5 is a side view of the dart game of FIG. 4, partially in section.
Figure 6:
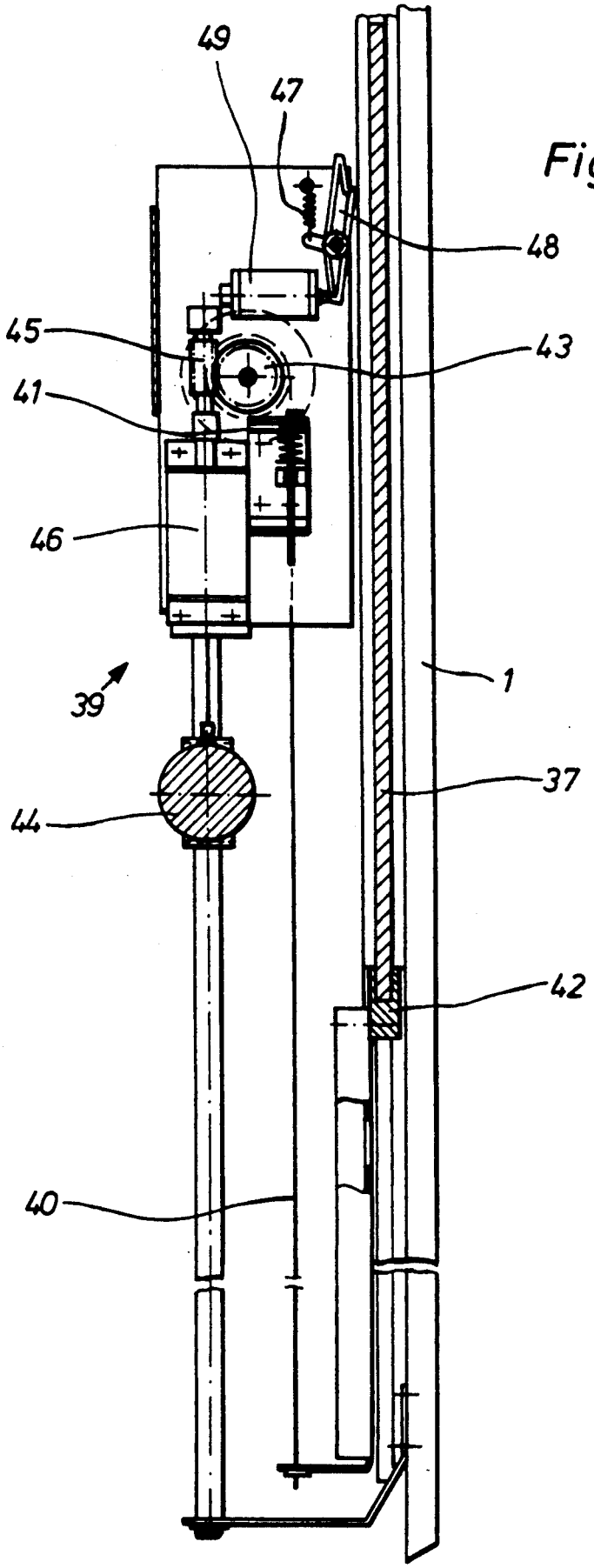
FIG. 6 is a side view to an enlarged scale of the actuating device for the cover plate of the dart game of FIG. 4.

In the alternative dart game shown in FIGS. 4–6, housing 1 is provided with a supporting base 35 and a projecting structure 36 disposed below dart target disk 4. This projecting structure is equipped with the various operating elements 6, such as game selection keys, displays 7 for the selected type of game and a coin insertion slot 8. Above dart target disk 4, there are disposed, in the frontal face of housing 1, displays 9 for indicating the points earned. A glass cover plate 37 is spaced from dart target disk 4 by a distance which is greater than the distance between the outer ends of darts 38 stuck in dart target disk 4 and dart target disk 4. Glass cover plate 37 is disposed in front of dart target disk 4 so as to be retractable into the lower portion of housing 1. Thus, cover plate 37 is able to unimpededly move from its open position in the lower portion of housing 1 into the closed position in the upper portion of housing 1 in spite of darts 38 stuck in dart target disk 4. Cover plate 37 is coupled with an actuation device 39 with which cover plate 37 is automatically moved into the open position at the beginning of a coin-operated game and into the closed position at the end of this game. A holder 42 connected with a cable 40 equipped with an integrated compensating spring 41 holds cover plate 37 at its lower edge. A counterweight 44 is fastened to the other end of cable 40, which is guided around a reversal roller 43. By way of a gear assembly 45, reversal roller 43 is in operative connection with a drive motor 46. The closed position of the cover plate is associated with a locking device 48 charged by a spring 47 to lock cover plate 37 in its closed position. An electromagnet 49 coupled with locking device 48 serves to release it.

For a realization of the various embodiments of the invention, the features of the invention disclosed in the above specification, the drawing figures and the claims may be significant individually as well as in any desired combination.

What I claim is:

1. In a dart game including a dart target disk attached in an opening in the front wall of a housing, with said dart target disk including movable segments which are assigned different numbers of points and are provided with holes to receive the darts so as to actuate, by way of an elastic support, a group of switches disposed between said support and a carrier plate when a dart strikes a segment, permitting by way of electrical and/or electronic components automatic recording, counting and display of the points earned, the improvement comprising:

a first support means for supporting a unit on said dart target disk, said unit including said elastic support, said group of switches, and said carrier plate;

a second support means for supporting said dart target disk on said front wall;

said dart target disk together with said unit being pivotable about said second support means for movement between a generally vertical position and a position in which said dart target disk and unit extend outwardly relative to the front wall and thereafter said unit being pivotable about said first support means to an unfolded position in which said unit is unfolded away from the dart target disk.

2. A dart game according to claim 1, wherein the elastic support, the group of switches, and the carrier plate are light transmissive, and further comprising a light source within the housing behind the carrier plate.

3. A dart game according to claim 2, wherein the light source is arranged centrally relative to the carrier plate, and further comprising a reflector which covers the entire carrier plate.

4. A dart game according to claim 1, wherein the dart target disk is provided with ribs, wherein the carrier plate is provided with a plurality of receiving pins which are disposed behind the ribs of the dart target disk so as to project in the direction of the target disk, and wherein the switch group as well as the elastic support are fastened to the carrier plate by way of bores mating with the receiving pins.

5. A dart game according to claim 1, wherein the dart target disk is surrounded by segments which are fixedly disposed along its periphery and are not assigned any point numbers, said segments being pivotable away from the generally vertical position together with the dart target disk.

6. A dart game according to claim 1, wherein said second support means comprises a hinge, the dart target disk being held at the front wall of the housing by way of the hinge of the second support means, and further comprising a locking device disposed opposite the hinge of the second support means.

7. A dart game according to claim 6, further comprising a stop in the front wall of the housing, and wherein the first support means comprises a hinge, the carrier plate being connected with the dart target disk by way of the hinge of the first support means and, when pivoted to the unfolded position, lying against the stop in the front wall of the housing.

8. A dart game according to claim 7, wherein the hinge of the second support means is disposed between the dart target disk and the front wall in the lower region of the opening of the front wall, and wherein the hinge of the first support means lies between the carrier plate and the dart target disk in the same plane as the hinge of the second support means; and further comprising holding device means for fixing the carrier plate together with the switch group and the elastic support can be in their unfolded position.

9. A dart game according to claim 1, further comprising a removable cover plate attached in front of the dart target disk.

10. A dart game according to claim 9, wherein the cover plate is composed of glass or some other transparent material.

11. A dart game according to claim 9, wherein the cover plate is disposed at a distance from the dart target disk which is greater than the distance between the free ends of darts stuck in the dart target disk and the dart target disk, and further comprising means for retracting the cover plate into the housing.

12. A dart game according to claim 11, wherein the means for retracing the cover plate comprises actuation device means, coupled to the cover plate, for automatically moving the cover plate into open and closed positions.

13. A dart game according to claim 12, wherein the actuation device means comprises a holder supporting the lower edge of the cover plate a reversal roller, a cable with an integrated compensating spring, the cable being connected with the holder and being guided about the reversal roller, a counterweight fastened to an end of the cable, a gear mechanism, and a drive motor coupled with the reversal roller by way of the gear mechanism.

14. A dart game according to claim 12, further comprising locking device means for holding the cover plate in its closed position, a spring, and an electromagnet, the locking device means being charged by the spring and being actuated by the electromagnet.

* * * * *